US005948728A

United States Patent [19]

Patton et al.

[11] Patent Number: 5,948,728

[45] Date of Patent: Sep. 7, 1999

[54] KIT AND METHOD FOR PRODUCING IMAGES ON A MUG

[75] Inventors: David L. Patton, Webster; Raymond E. Wess, Holley; Ralph L. Piccinino, Jr., Rush, all of N.Y.

[73] Assignee: Eastman Kodak Company, Rochester, N.Y.

[21] Appl. No.: 08/839,332

[22] Filed: Apr. 17, 1997

[51] Int. Cl.[6] ..... B41M 5/035; B41M 5/38

[52] U.S. Cl. ..... 503/227; 428/195; 428/913; 428/914; 503/201; 156/235

[58] Field of Search ..... 8/471; 156/235; 503/227, 201; 428/195, 913, 914

[56] References Cited

U.S. PATENT DOCUMENTS 3,030,004 4/1962 Pieronek et al. .
4,758,952 7/1988 Harris, Jr. et al. .
4,989,508 2/1991 King .
5,019,193 5/1991 Arammi .
5,246,518 9/1993 Hale .
5,248,363 9/1993 Hale .
5,296,081 3/1994 Morin et al. .
5,302,223 4/1994 Hale .
5,424,141 6/1995 Croner .

*Primary Examiner*—Bruce H. Hess
*Attorney, Agent, or Firm*—Frank Pincelli

[57] ABSTRACT

A method and kit for transferring personalized images on mugs or similar-type articles. The kit includes an instruction and order entry sheet for selecting a desired transfer medium for receiving a predetermined image thereon capable of being transferred onto a mug. The kit may also include a mailer having means for holding and containing the order of entry and a customer image which is to be incorporated into said transfer medium. A clamp is provided for clamping of the transfer medium onto said mug while in a heated environment.

8 Claims, 18 Drawing Sheets

ORDER FORM

1. NAME: _____

2. ADDRESS: _____
_____
_____

3. MUG TYPE #: _____

4. PRINT/NEGATIVE #: _____

5. IMAGE LOCATION #1 A B C
IMAGE LOCATION #2 A B C

6. BORDER: YES ____
NO ____
BORDER CODE ____

7. FONT: NO ____
YES ____
FONT CODE ____
FONT SIZE ____

8. MESSAGE:

P1/P2-X1
P3/P4-X1
P1/P2-X2
P3/P4-X2
P1/P2-X1
P3/P4-X3
P1/P2-X4
P3/P4-X4

9. MESSAGE PLACEMENT: _____

50

FIG. 10

BORDER CHOICES:

FONT CHOICES: CAESAR F1 BAZOOKA F2 MARKET F3 TIMES F4

FONT SIZES: 5 X1 7 X2 10 X3 20 X4

KIT AND METHOD FOR PRODUCING IMAGES ON A MUG

FIELD OF THE INVENTION

The present invention relates to providing images on mugs and similar-type articles, and more particularly, to a kit and method for providing personalized images on mugs and similar-type articles.

BACKGROUND OF THE INVENTION

Current methods of providing personalized images on mugs and similar-type articles require relatively expensive equipment. In particular, a consumer typically goes to a third party where an image is electronically taken through the use of a video camera, and is then produced onto a transfer medium. The image on the transfer medium is then transferred to the mug through the use of a relatively expensive mug press, such as illustrated in U.S. Pat. Nos. 5,019,193 and 5,296,081. For a typical individual consumer, it is not cost effective to own these expensive types of equipment. Furthermore, an ordinary consumer would typically not have the skills or knowledge to produce high quality images for transferring onto a mug using this equipment In addition, there is relatively limited opportunity for the consumer to personalize or add creativity to the image to be transferred to a mug without substantial cost.

SUMMARY OF THE INVENTION

Thus, there is a need to provide a system for allowing consumers to easily provide personalized images on mugs and similar-types articles without the need for expensive equipment, interaction with a third party, or specialized knowledge and training.

Applicants have invented a kit and method whereby consumers can, in their own home, design and create customized images that can be transferred onto mugs or other similar like objects.

In accordance with one aspect of the present invention, there is provided a kit for producing images on a mug. The kit comprising:

a) a mug;

b) at least one transfer medium for receiving an image thereon from a printer; and c) computer software program for controlling a computer for manipulation of an image that is to be placed on the transfer medium by the printer.

In accordance with another aspect of the present invention, there is provided a kit for producing images on a mug. The kit comprising:

a) instruction and order entry sheet for selecting a desired transfer medium for receiving a predetermined image thereon capable of being transferred onto a mug; and b) a mailer having means for holding and containing the order and a customer image which is to be incorporated into the transfer medium.

In accordance with yet another aspect of the present invention, there is provided a method for producing images on a mug, comprising the steps of:

a) providing a mug;

b) providing a transfer medium having an image thereon capable of being transferred to the mug, the medium having instructions thereon for use and having complex size template outlines for use in sizing the temperature of the transfer medium to the mug;

c) a clamp for clamping of the transfer medium onto the mug; and d) subjecting the mug to a sufficient heat so as to transfer the image onto the mug.

DESCRIPTION OF THE DRAWINGS

Other objects, advantages and features of the present invention will become apparent from the following specification when taken in conjunction with the drawings in which like elements are commonly enumerated and in which:

FIG. 10 is a plan view of an order form provided in the kit of FIG. 1;

Figure 1:
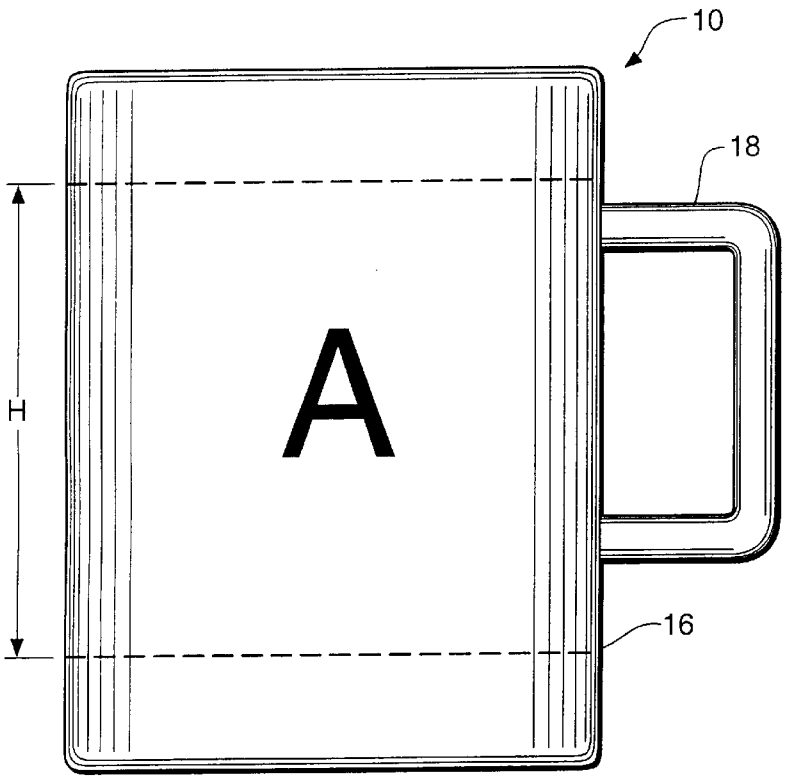
FIG. 1 is an elevational view of a mug for use in the kit according to the present invention capable of receiving sublimation dye transfer.
Figure 22:
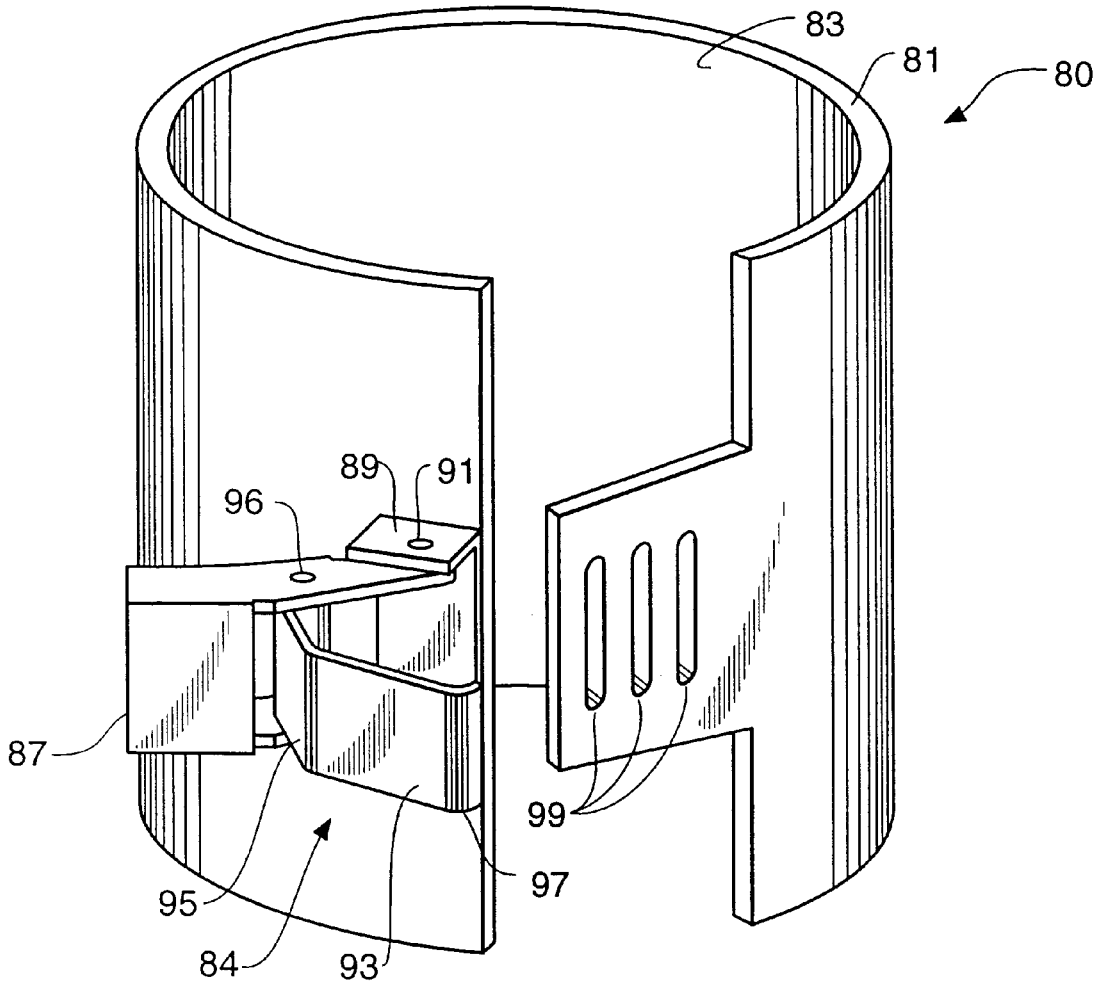
FIG. 22 is a perspective view of a clamp in the unclamped position for use in transferring an image to the mug of FIG.
Figure 23:
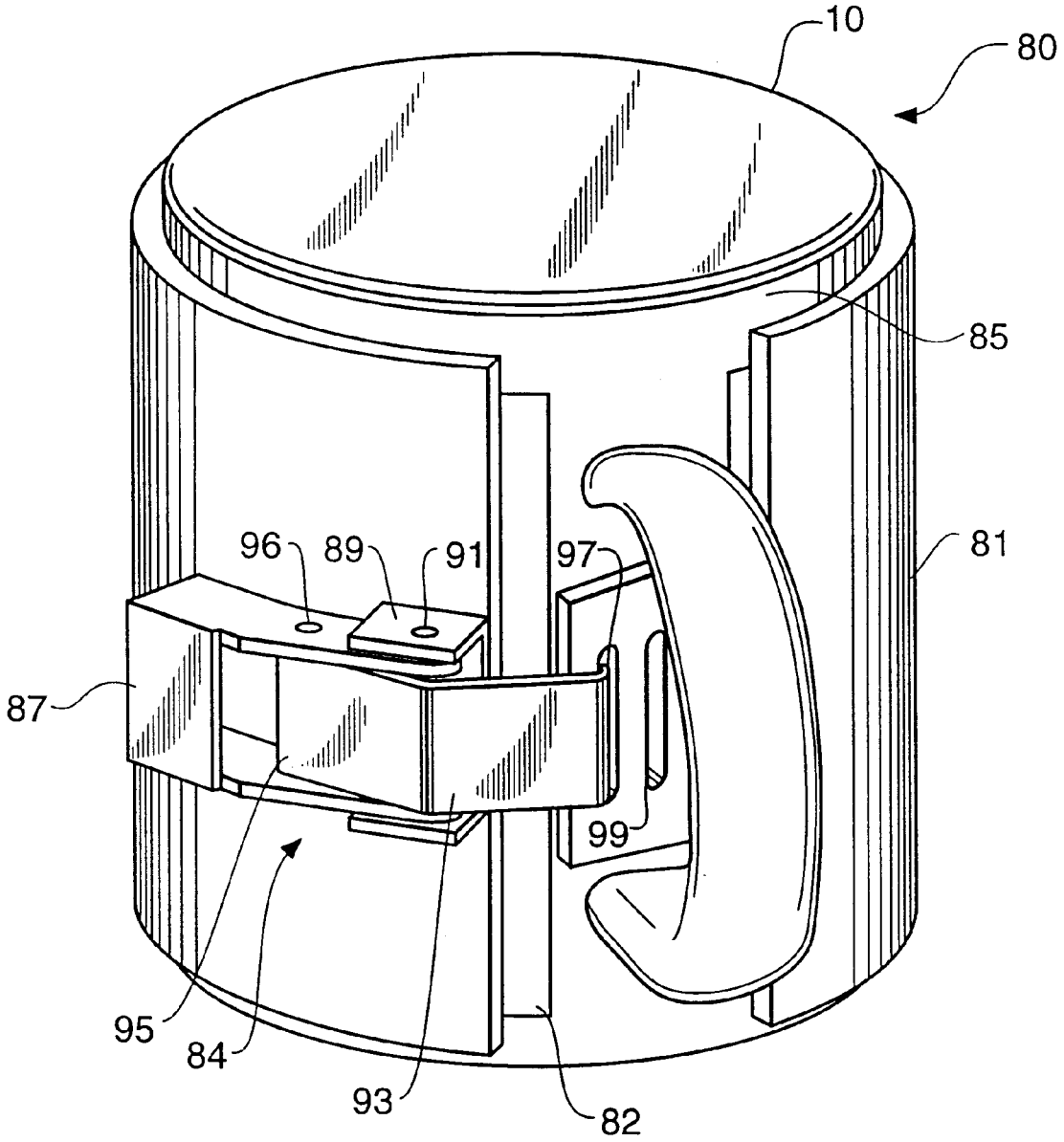
Figure 24:
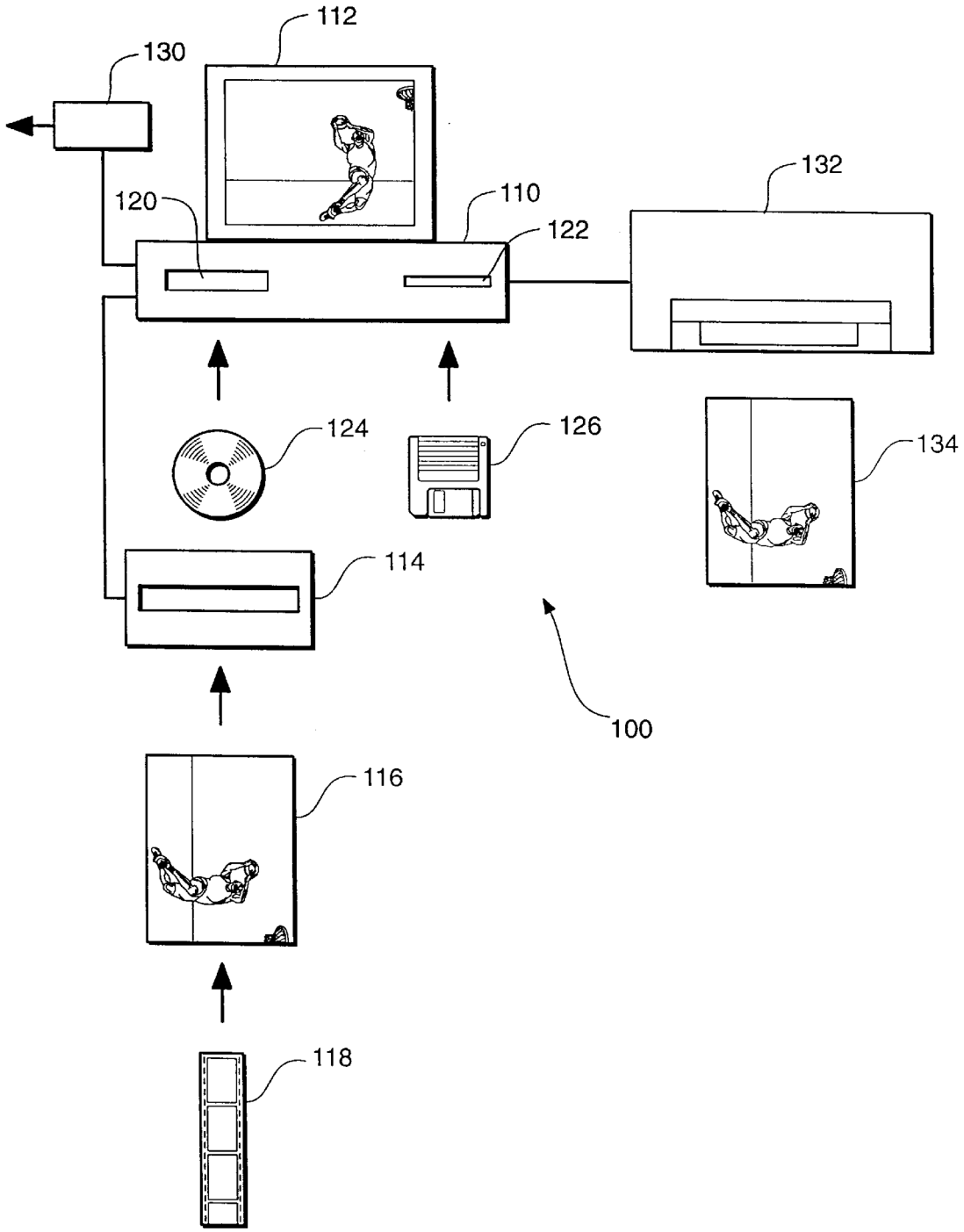
Figure 25:
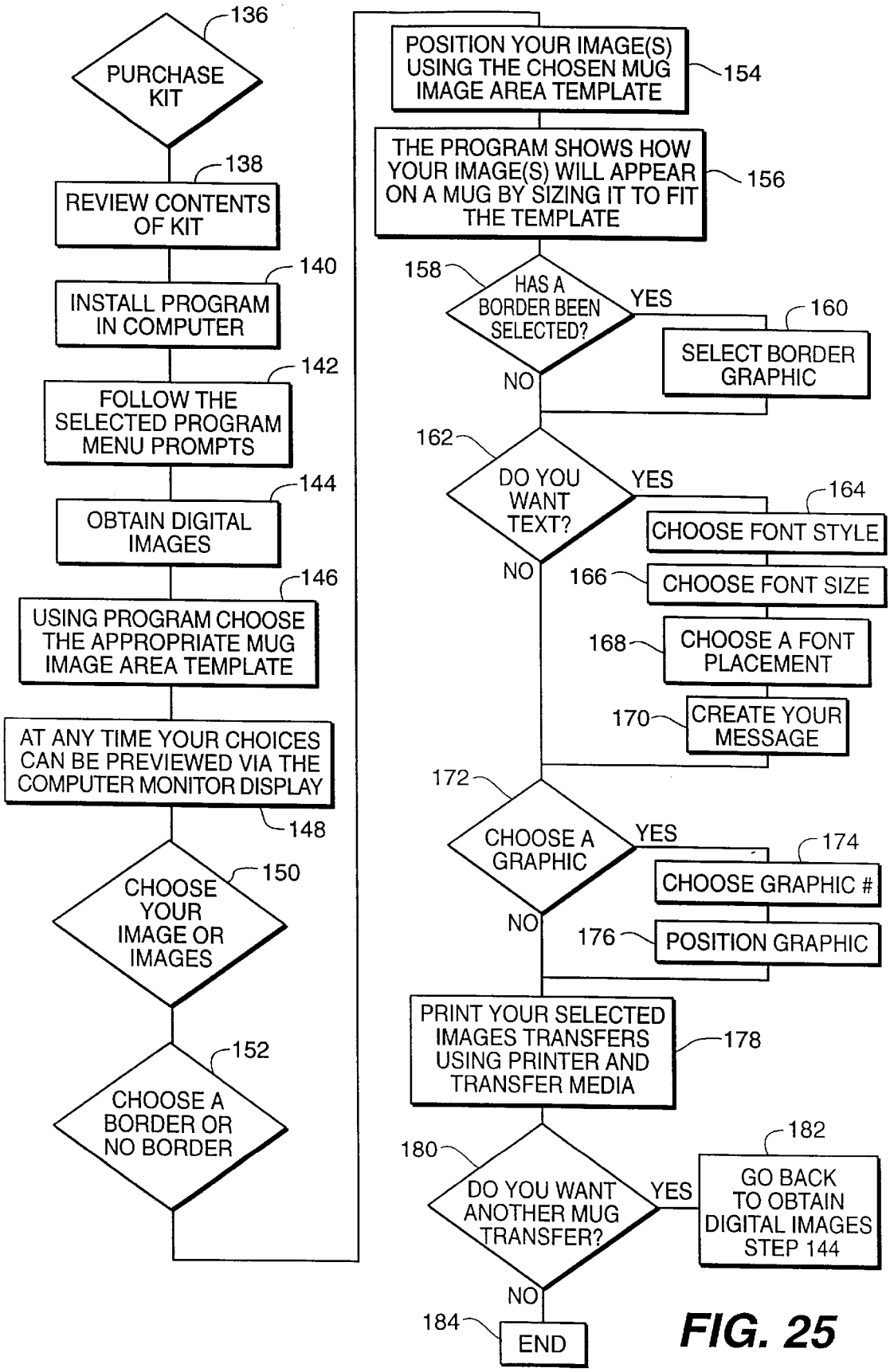

1 provided on a sublimation dye transfer having the ordered customer image;

FIG. 23 is perspective view of the clamp of FIG. 22 in the clamped position for use in transferring an image to the mug of FIG. 1 provided on a sublimation dye transfer having the ordered customer image;

FIG. 24 is a schematic representation of a computer printer system made in accordance with the present invention; and FIG. 25 is a flow chart of the operation of the computer system of FIG. 24.

DETAILED DESCRIPTION OF THE INVENTION

Figure 2:
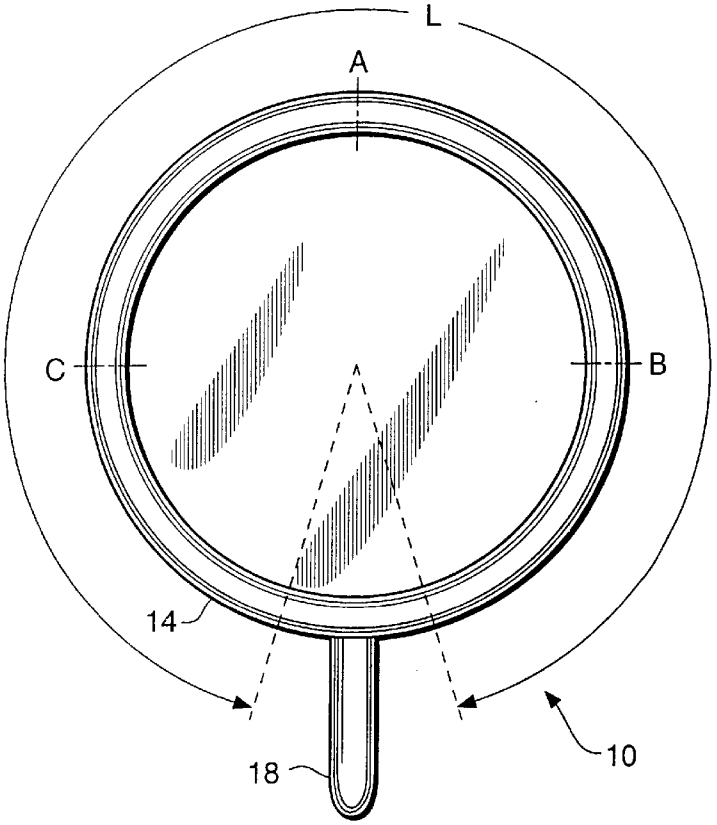
FIG. 2 is a top plan view of the mug of FIG. 1.

Referring to FIGS. 1 and 2, there is illustrated a mug 10 for use in the present invention. In the preferred embodiment illustrated, the mug 10 is part of a kit that is purchased by a consumer on which an image is to be transferred. In particular, the mug 10 has an outer peripheral wall 14 having an image area 16 on which the personalized image is to be placed. The image area 16 has a maximum height H as indicated by dash lines and a maximum length L (see FIG. 2). It is to be understood that the height H and the length L may be varied as desired and is constrained only by the size of the mug 10. The mug 10, as is traditional with such products, is provided with a handle 18. Preferably, the image area 16 is such that it stops short of the handle 18, as illustrated.

As also illustrated by FIGS. 1 and 2, there are three center lines, center line A, center line B, and center line C, about which images may be centered. Center line A is for centering an image about the end of the mug 10. Centering the image about center line A would typically occur for images having a greater horizontal length than vertical height. Center line B is for centering an image on the left side of the mug 10. Center line C is for centering of an image on the right side of the mug 10. Centering the image about center lines B and C would typically occur for images having a greater vertical height than horizontal length. In the preferred embodiment, these center lines are actually provided on the mug 10 and designed such that they can be removed prior to placement of the image on mug 10, or made of a substance that will become invisible upon the application of heat during transfer of the image onto the mug 10. For example, peelable decals illustrating the three center lines may be on the mug 10.

Figure 3:
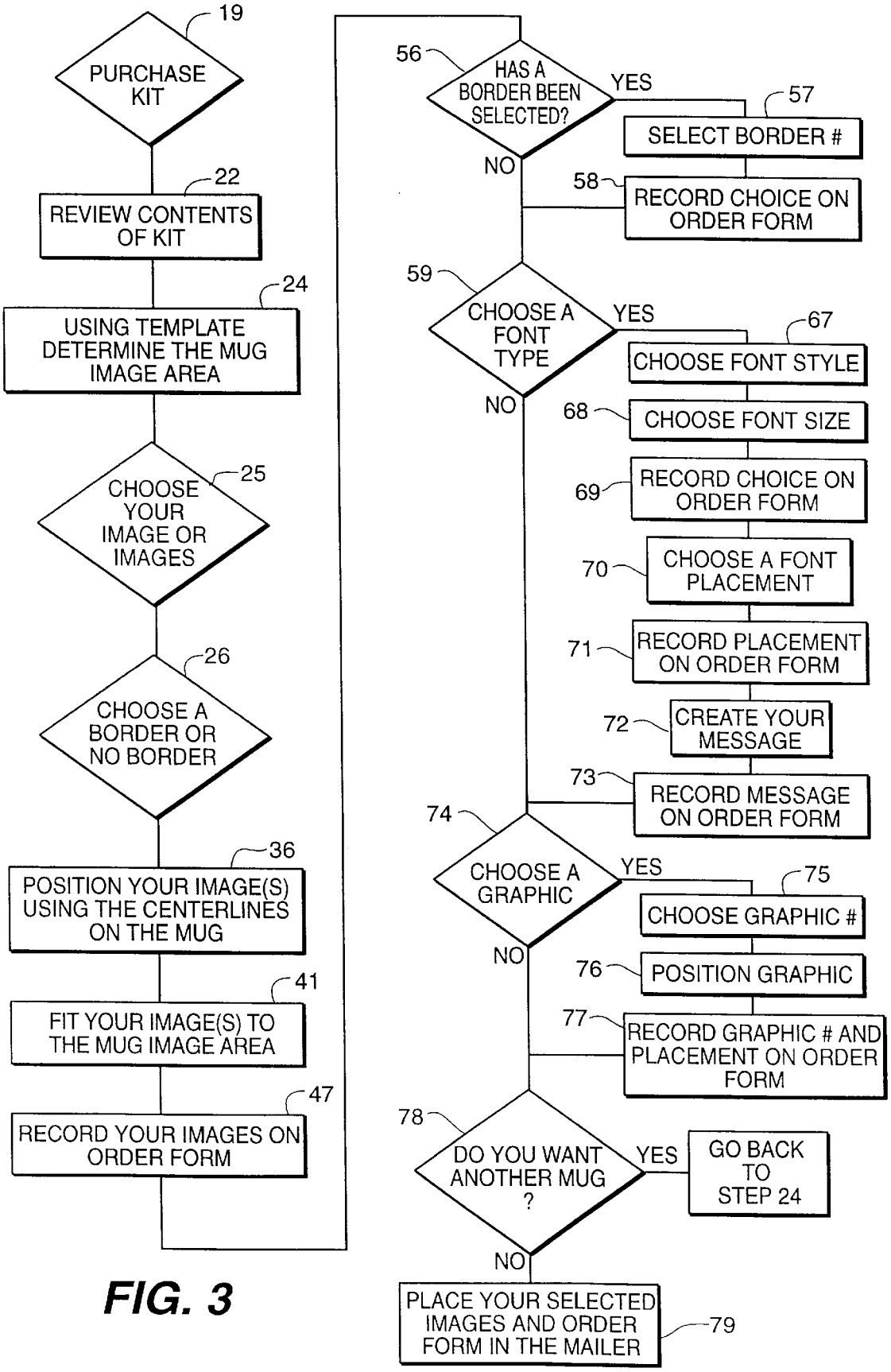
FIG. 3 is a flow chart of the method of using the kit according to the present invention.
Figure 4:
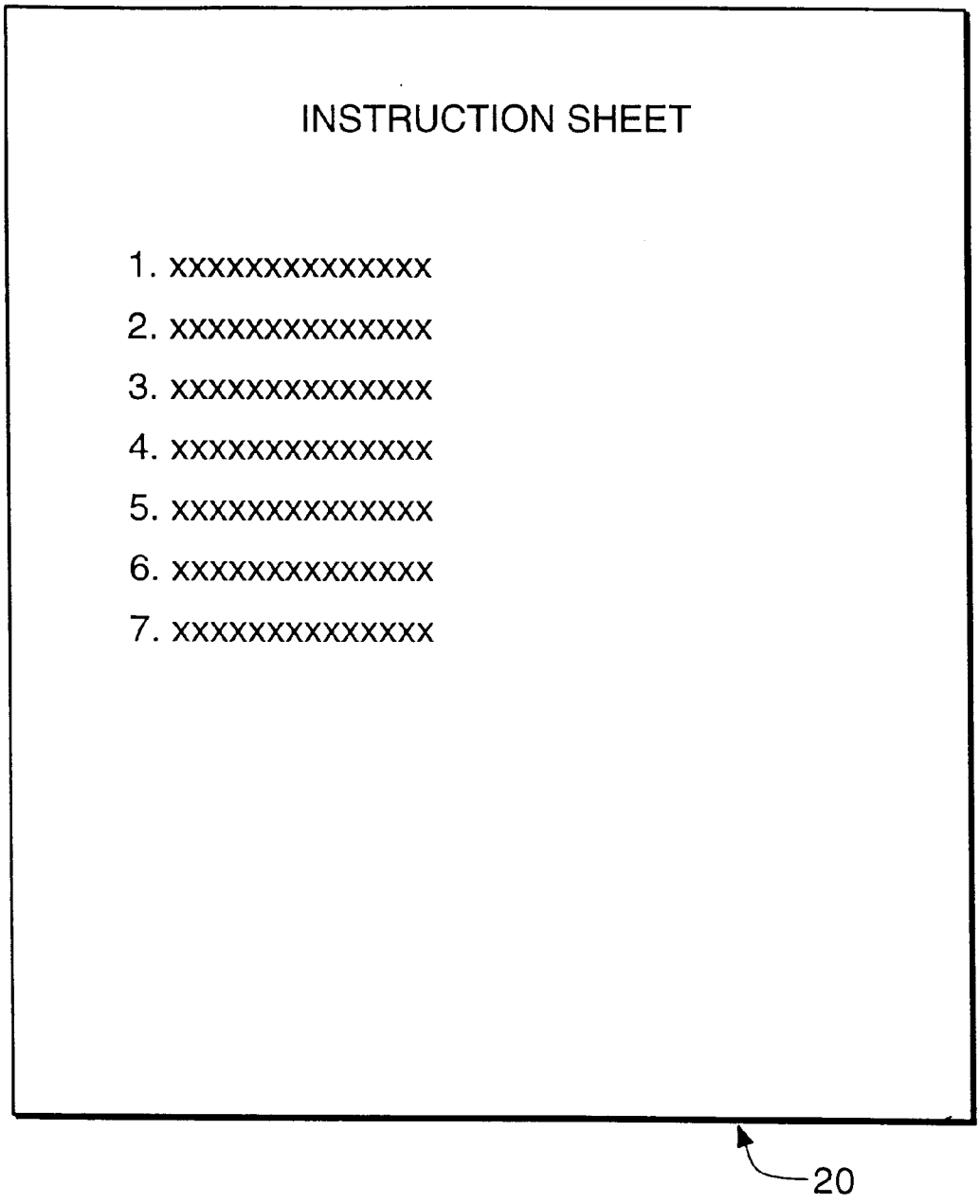
FIG. 4 is an instruction sheet included in the kit according to the present invention.

Referring to FIG. 3, there is shown a flow chart illustrating the method of providing a personalized image on a mug according to the present invention. The kit is purchased or otherwise provided to the consumer as indicated by step 19. The kit includes an instruction sheet 20 as illustrated by FIG. 4. The instruction sheet 20 sets forth a plurality of steps which the consumer follows. The first step 22 would be to review the kit contents to assure that all items are provided to the consumer.

Figure 5:
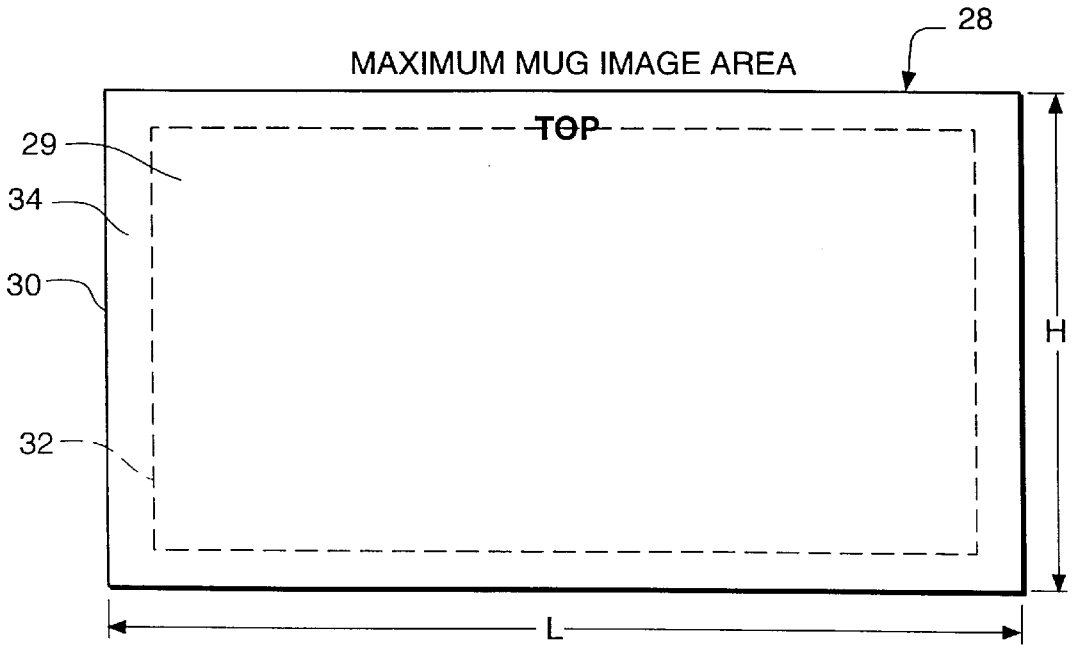
FIG. 5 is a template of the image receiving area of the mug of FIGS. 1 and 2.

The next step 24 is for the consumer to become familiar with template 28 provided in the kit, as illustrated by FIG. 5. The template 28 illustrates the maximum image area 29 available to receive an image. The template 28 preferably illustrates the image area 29 in the identical size of the actual image area 16 provided on mug 10. As can be seen, the template 28 includes a peripheral line 30, which is representative of the outer periphery of the image area 16 illustrated by H and L in FIGS. 1 and 2. An inner peripheral line 32 is provided inside of peripheral line 30 indicating a border area 34 which may be used to receive border patterns available to the consumer as discussed later herein.

The next step, indicated by numeral 25, is for the consumer to select the image or images 35 (see FIG. 6) that are to be placed on the mug 10. This can take the form of reviewing photographic prints or negatives. In the embodiment illustrated, prints are preferably used as they illustrate the image in a form that is readily and easily used by the consumer.

In the following step 26, the consumer decides whether or not the border area 34 is to be used in conjunction with the image to be placed on the mug 10. This information is recorded on order form 50 (see FIG. 10) which is also provided in the kit.

Figure 6:
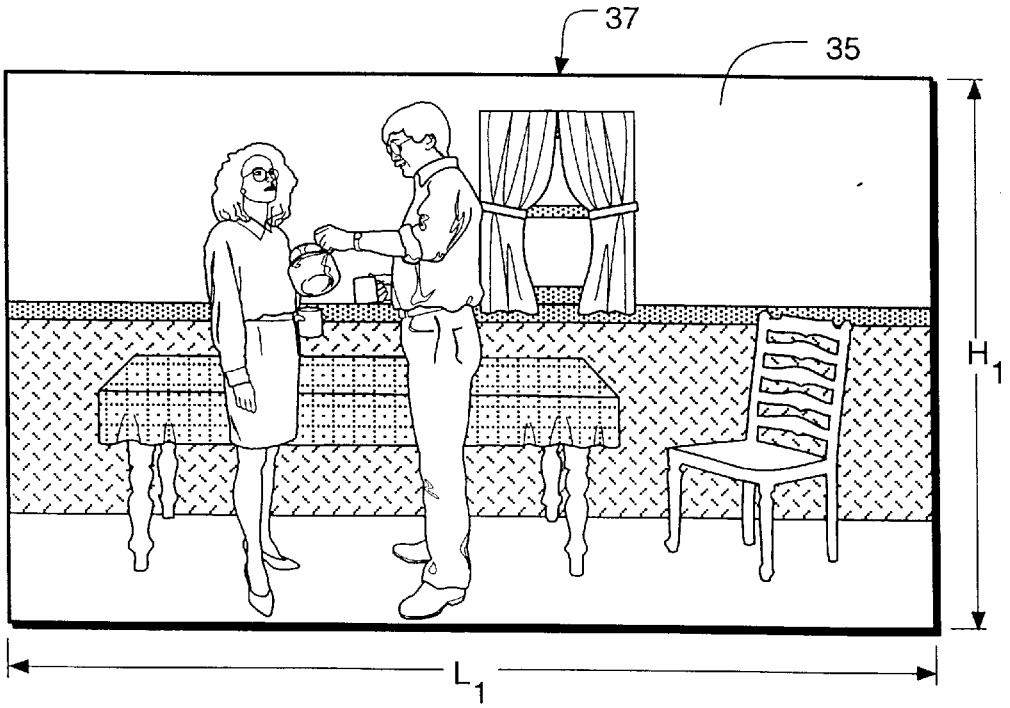
FIG. 6 is an illustration of a horizontal customer image to be placed on the mug.

In the next step 36, the consumer determines the orientation of the selected image 35 with respect to the mug 10. The consumer aligns the top of the selected image 35 with respect to the top of the image area 16 on the mug 10. For example, referring to FIG. 6, there is illustrated an image 35 of print 37 that the consumer has selected for placement on mug 10. The consumer orients the image 35 such that the top of image 35 is in the same orientation as the notation TOP indicated on the template 28 in FIG. 5. FIG. 6 illustrates a typical photographic print having an image 35 having a generally horizontal aspect ratio (AR), that is, a print having a length L1 greater than it height H1.

Figure 7:
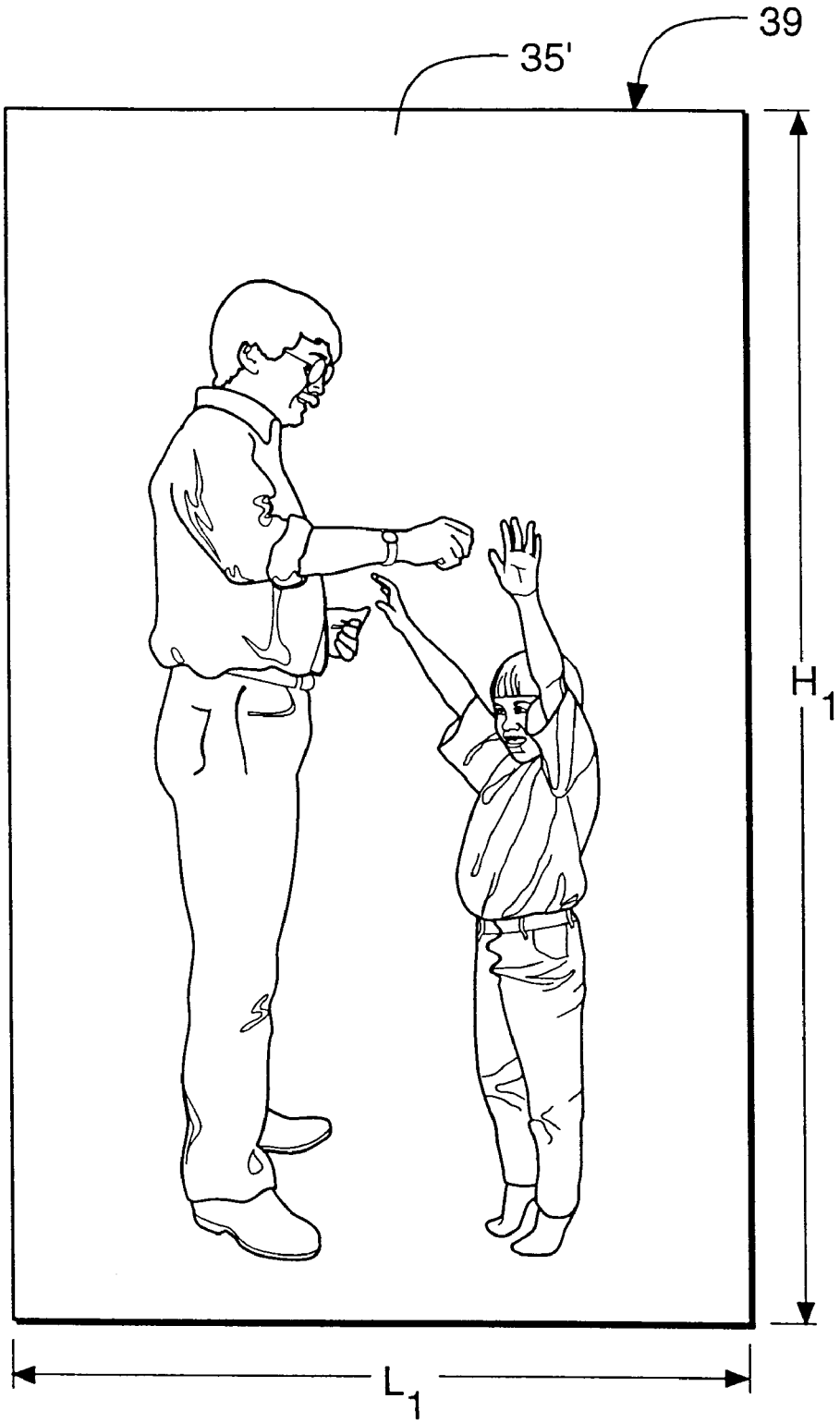
FIG. 7 an illustration of a vertical customer image to be placed on the mug.

Referring to FIG. 7, there is illustrated a second photographic print 39 having a generally vertical aspect ratio, that is a print having a height H1 greater than its length L1. The orientation of image 35' may be accomplished by directly placing the top of image 35' on the TOP of the template 28 of FIG. 5.

Figure 8:
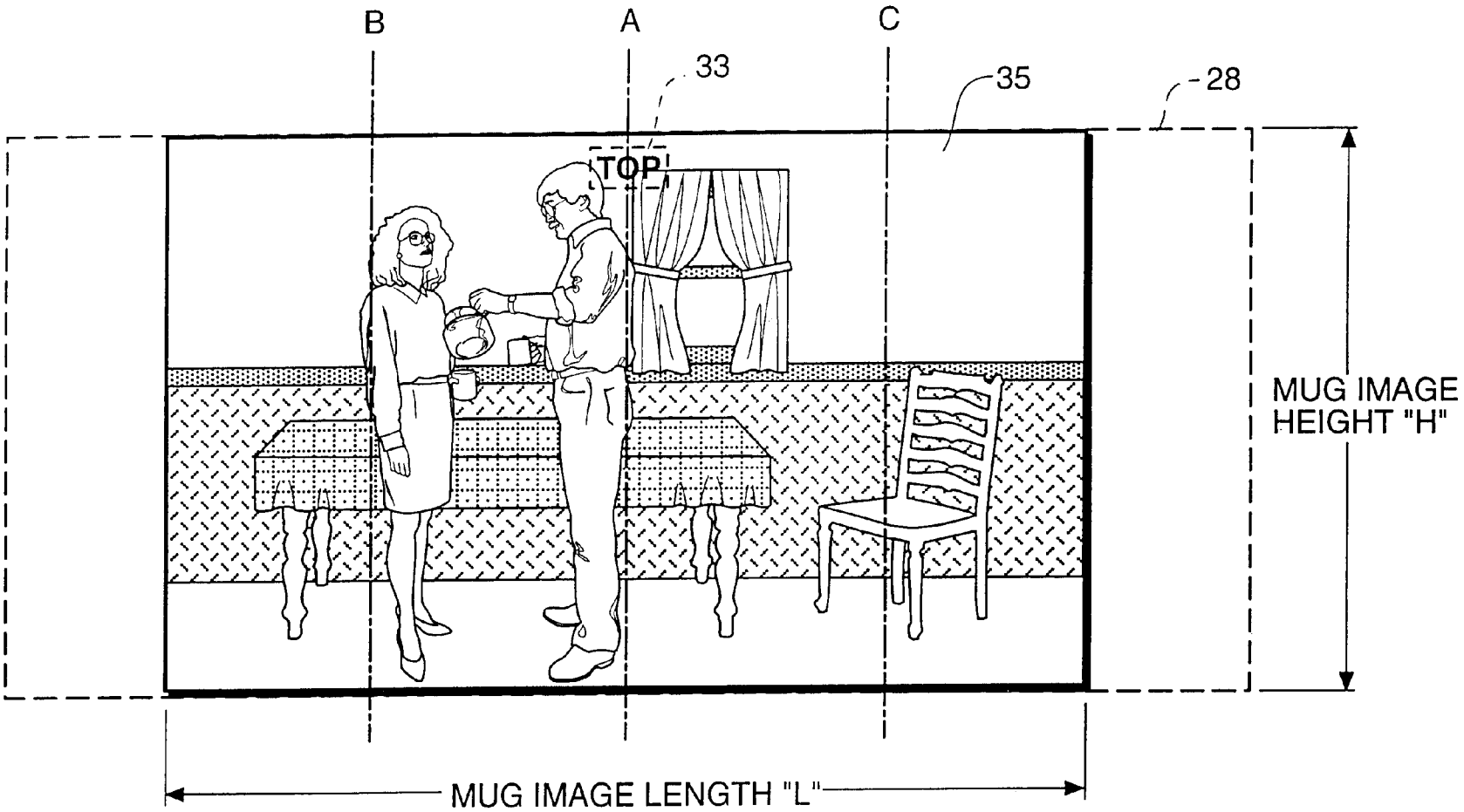
FIG. 8 is schematic illustration of the image of FIG. 6 as to how it would be combined with the schematic illustration of FIG. 5.

FIG. 8 illustrates an example of image 35 of FIG. 6 placed on the template 28 of FIG. 5. It is to be understood that the image 35 may, in actuality, be larger than the template 28. Thus, only the generally overall orientation of the image has been determined. The selected print will be forwarded with the customer order for obtaining the desired transfer medium. In order to properly record the top of the image 35 on the print, a peelable decal 33 which reads "TOP" is placed on the print in the middle of the side which is top of the image. The decal 33 may be placed on a negative or other hard copy from which the image is to be obtained.

Figure 9A:
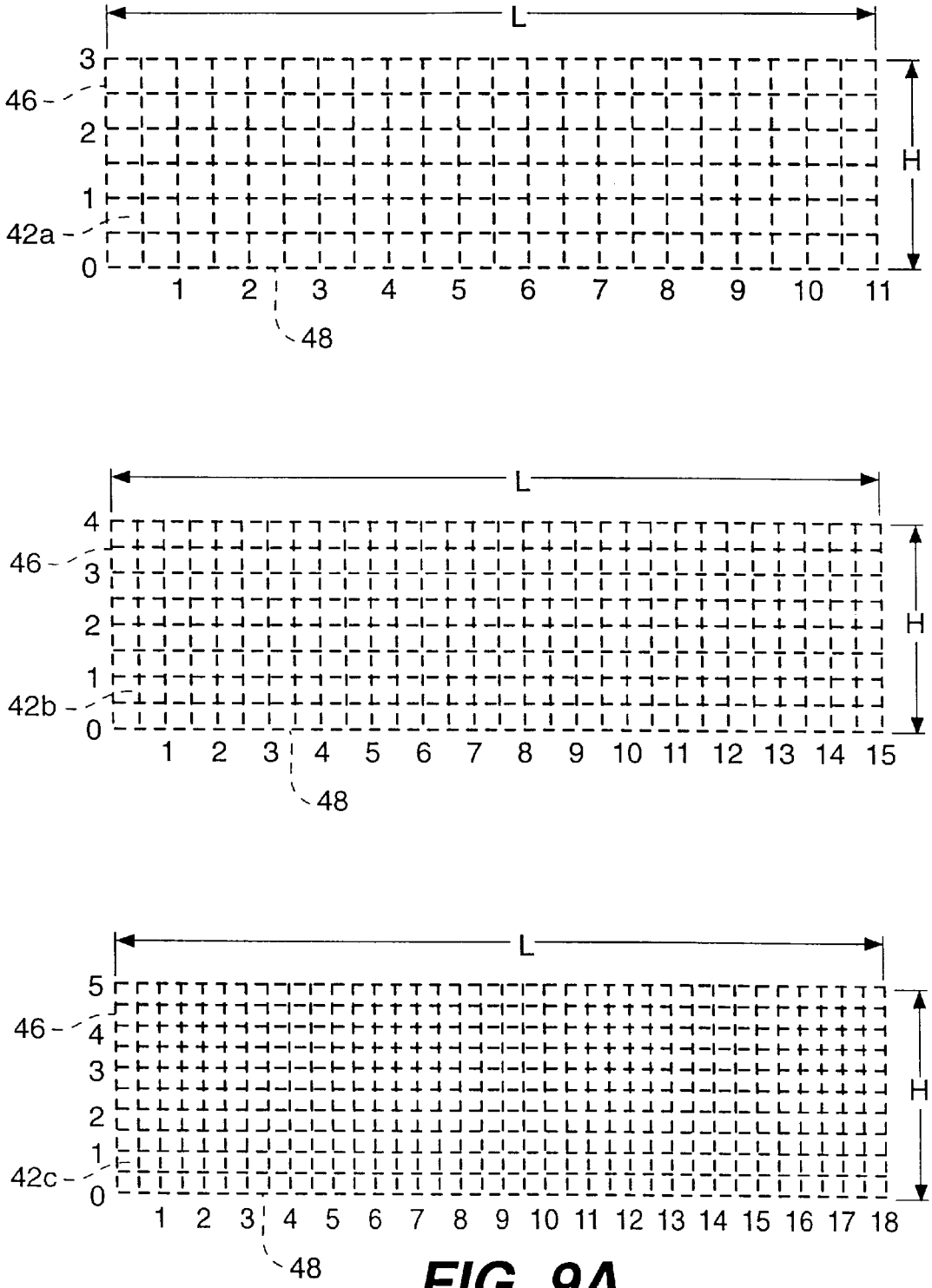
FIGS. 9A and 9B illustrate various location templates for sizing and placement of an image using the template of FIG. 5.
Figure 9B:
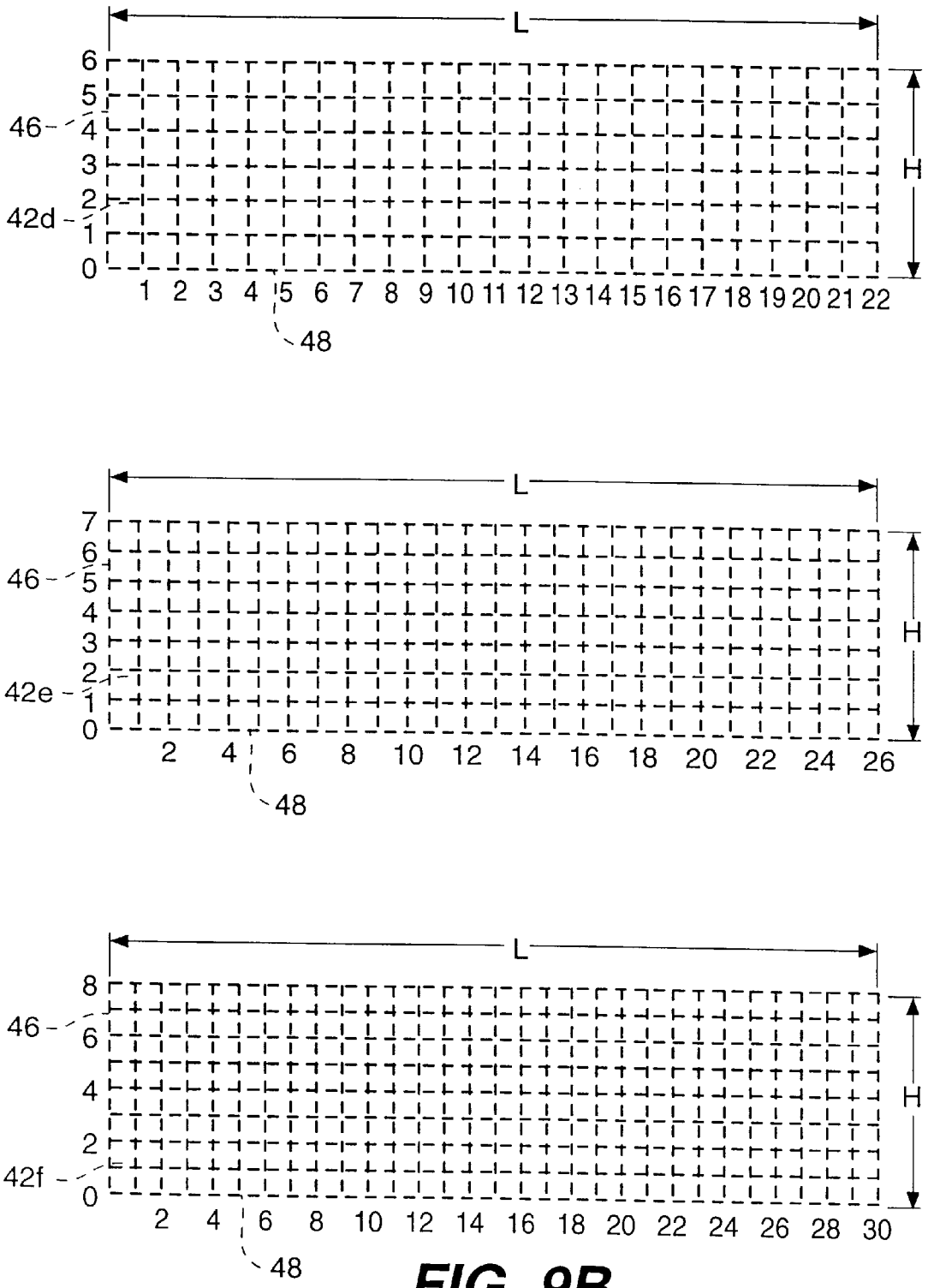

The consumer, at the next step 41, as illustrated in FIG. 3, fits the image to the mug image area. The kit is provided with a plurality of different location templates 42*a*, 42*b*, 42*c*, 42*d*, 42*e*, 42*f*, as illustrated by FIGS. 9A and 9B, which are used to assist in locating the image or images. Each of the templates have a vertical axis 46 and horizontal axis 48 provided with numbers along the horizontal axis which are numbered in a corresponding relationship to the height H and length L of the image area 16 of the mug 10. Each of the templates 42*a–f* have a maximum vertical scale for vertical axis 46. For example, template 42*a* has a 3 inch maximum scale, template 42*b* has a 4 inch maximum scale, 42*c* has a 5 inch maximum scale, 42*d* has a 6 inch maximum scale, template 42*e* has a 7 inch maximum scale, and template 42*f* has a 8 inch maximum scale. The consumer measures the height H1 of image 35 and selects the template having the closed maximum vertical scale that is equal to or greater than height H1. For example, if image 35 has a height H1 of 4.0 inches, template 42*b* is used, if the height H1 is 4.5 inches, then template 42*c* is used. It is to be understood that the templates 42*a–f* are designed for a specific size mug with a predetermined image area and that different templates would be used for different size mugs. Once having determined the correct template to use, the size of image 35 is marked off on the template and is cut out to form a cut-out template 49 which is to be used with template 28. Preferably, the cut-out template is measured from two adjacent sides of the template that start from the bottom left corner. If a 4×6 inch image is to be placed on the mug 10, the template 42*b* would be used. The cut-out template 49 is then placed on template 28 and moved by the consumer to various positions available, preferably centering the cut-out at each of the center lines. The consumer can also readily determine if a second image can be placed on the mug 10 by simply using the remaining portion of the template if available. If the desired size image can be cut from the remaining template and if both can be located about a center line on template 28, then both images can be provided on the transfer medium for transferring onto the mug 10 as later described herein.

Figure 11:
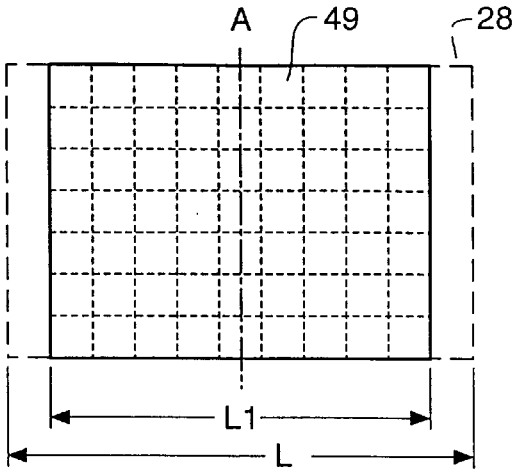
FIG. 11 is an illustration of an image representation obtained from one of the templates of FIGS. 9A or 9B as placed on the template of FIG. 5.
Figure 12:
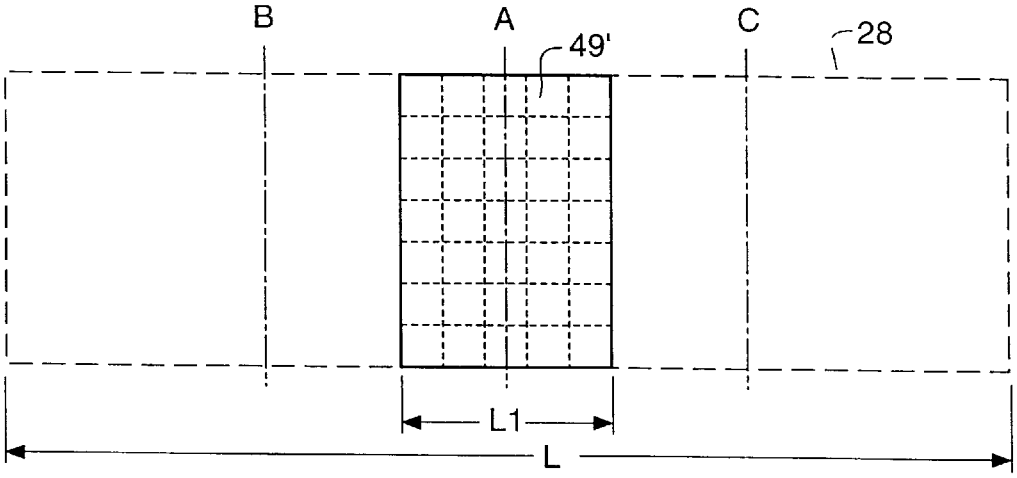
FIG. 12 is an illustration of a second image representation obtained from one of the templates of FIGS. 9A or 9B as placed on the template of FIG. 5.

Referring to FIGS. 11 and 12, there is shown different cut-outs location templates placed on the template 28 of FIG. 5. In particular, FIG. 11 illustrates how a horizontal image would appear when placed on the image area 16. As can be seen, the length L1 of the image 35, represented by the cut-out template 49, is equal to or slightly less than the length L of the image area 16. With regard to FIG. 12, this illustrates a vertically oriented cut-out template 49' disposed along one of the center lines of the template 28. In particular, the length L1 of the image 35 is also equal to less than the length L of the image area 16.

Figure 13:
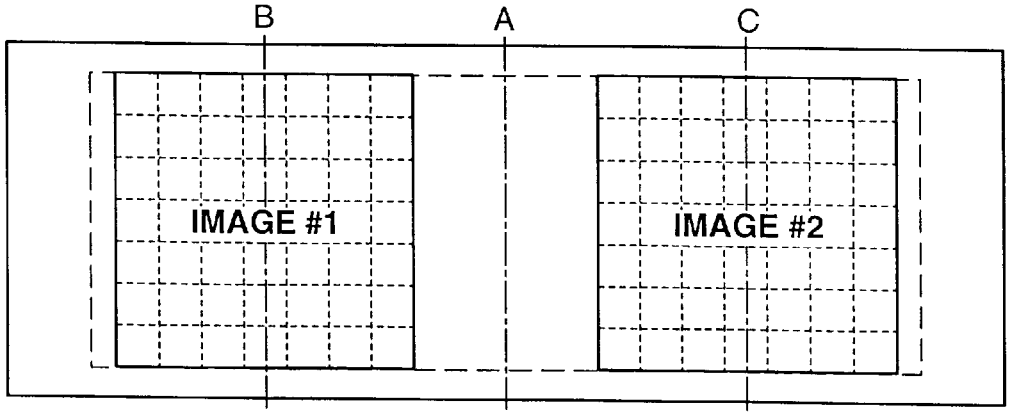
FIG. 13 is an illustration of two image representations obtained from the templates of FIGS. 9A or 9B as placed on the template of FIG. 5.

FIG. 13 illustrates a representation of where two vertical cut-outs would appear on image area 16 wherein a border area is provided.

Figures 14, 15, 16:
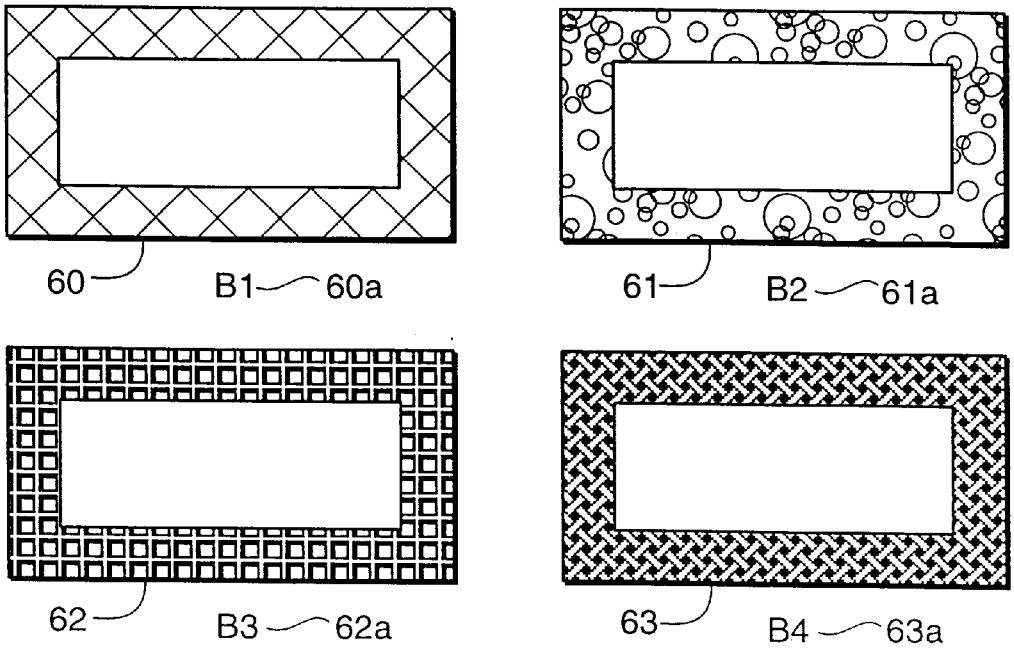
FIG. 14 is a schematic representation of several type border designs from which the consumer may select a desired border pattern.
FIG. 15 is a schematic representation of several types of fonts from which the consumer may select a desired font.
FIG. 16 is a schematic representation of various font sizes from which the consumer may select a desired size font.

The next step in the process, illustrated by numeral 47 as shown in FIG. 3, wherein the customer records the image placement on the order form as shown in FIG. 10. The customer, at steps 56, 57, 58, then selects a border pattern if the consumer previously decided to have a border. In particular, FIG. 14 illustrates four different types of border patterns 60, 61, 62, 63 that are available, and codes 60*a*, 61*a*, 62*a*, 63*a* associated with each of the respective border patterns 60, 61, 62, 63. In the particular embodiment illustrated in FIG. 14, four different patterns are illustrated, however, it is to be understood that any number of desired border patterns may be used. After the appropriate selection is made by the consumer, this information is placed on order form 50 as appropriate at step 58.

The consumer, at step 59, decides if text is to be provided. If text is to be provided, the font style and size needs to be selected as indicated by steps 67 and 68. FIGS. 15 and 16 illustrate various font styles and font sizes and their respective codes for selection by the consumer. If the consumer desires text, this selection will be appropriately noted on the order form 50, along with the appropriate font and font size selections at step 69.

Figure 17:
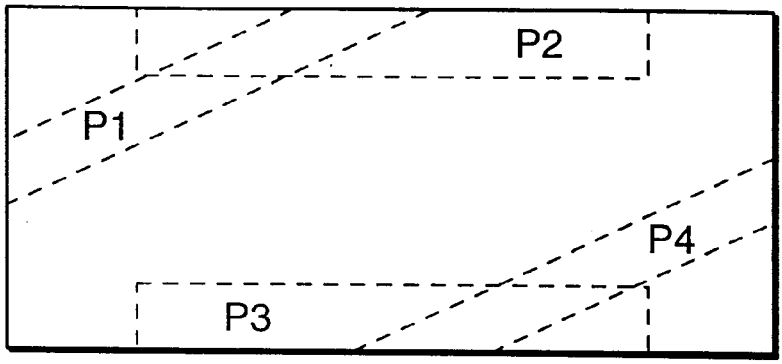
FIG. 17 is a representation of the template of FIG. 5 illustrating the various areas on the template where various text may be placed.

In step 70, the customer selects the appropriate placement of the text. As illustrated in FIG. 17, four placement sections, P1, P2, P3, P4 are provided wherein a text message can be placed. The appropriate desired number of text locations are selected and recorded on form 50 at step 71. It is to be understood that any desired number of placement sections may be provided of any size and at any desired location.

Figure 18:
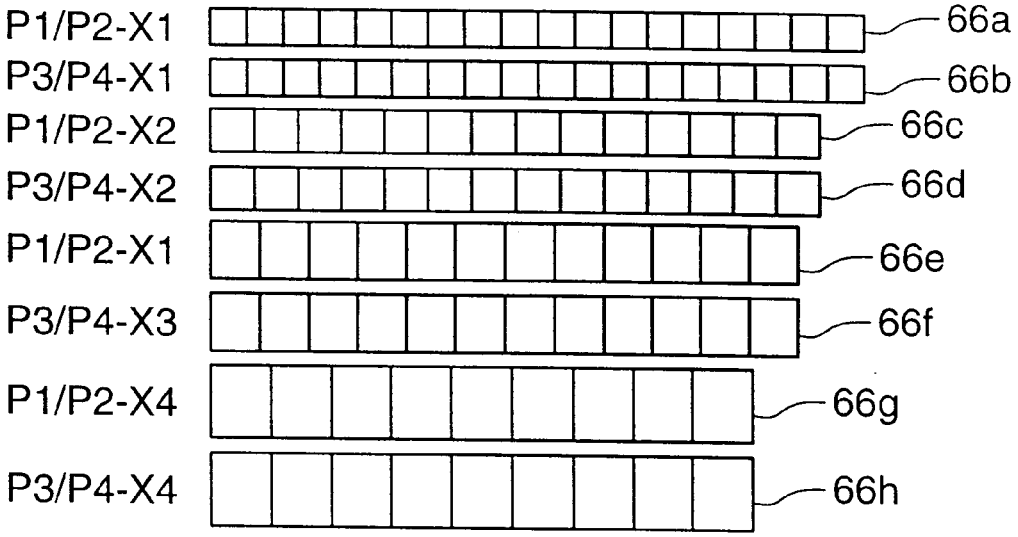
FIG. 18 is a text template that can be used by the consumer for sizing the message for the selected font size that is located on the customer order form.

At step 72, the customer provides the appropriate text message. Referring to FIG. 18, the customer is provided with various message boxes 66*a*, 66*b*, 66*c*, 66*d*, 66*e*, 66*f*, 66*g*, 66*h* on order form 50 wherein the appropriate text message is placed. The message sections 66*a–h* are of appropriate size to accommodate the appropriate size font previously selected. Thus, this assures that the message will be appropriately legible and in the appropriately defined place selected by the consumer. The P1, P2, P3, P4 notations indicate the positions at which the message may be provided, and the X indicates the font size.

Figure 19:
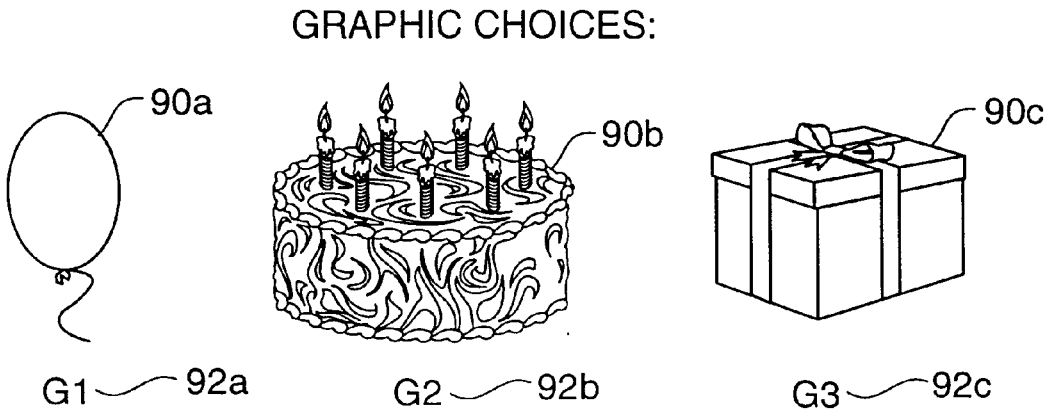
FIG. 19 is a schematic representation of several types of graphics from which the consumer may select a desired graphic.
Figure 20:
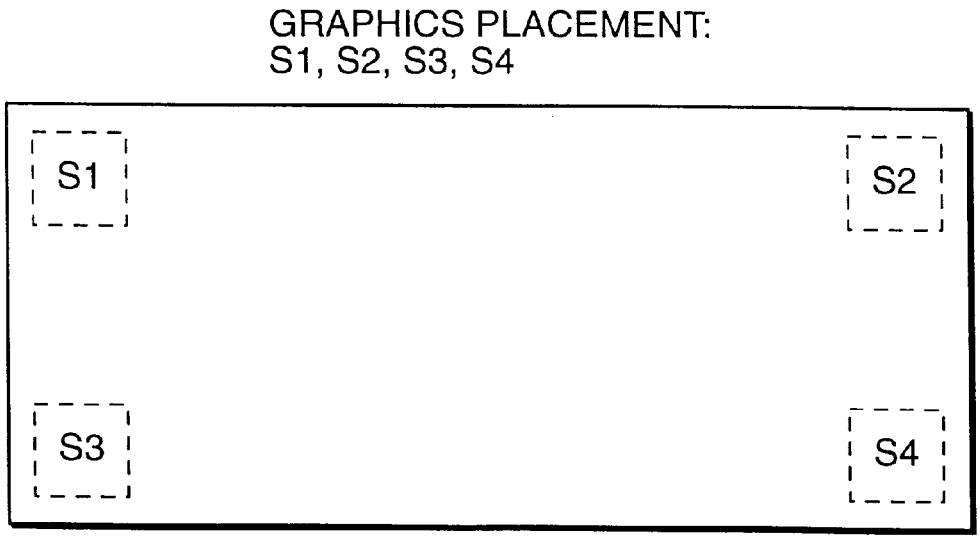
FIG. 20 is a representation of the template of FIG. 5 illustrating the various areas on the template where various graphics of FIG. 19 may be placed.

The next step 74 is for the consumer to decide if graphic representations are to be added. If the decision is yes, then the consumer goes to steps 75 and 76 to decide what graphics are to be used and where they are to be located. FIG. 19 illustrates various graphics 90*a*, 90*b*, 90*c* that may be selected, and the appropriate associated codes 92*a*, 92*b*, 92*c*, respectively, that is to be recorded in the appropriate section on order form 50 at step 77. FIG. 20 illustrates the various positions S1, S2, S3, S4 on the image area 16 where the graphics selected in the previous step may be placed.

Figure 21:
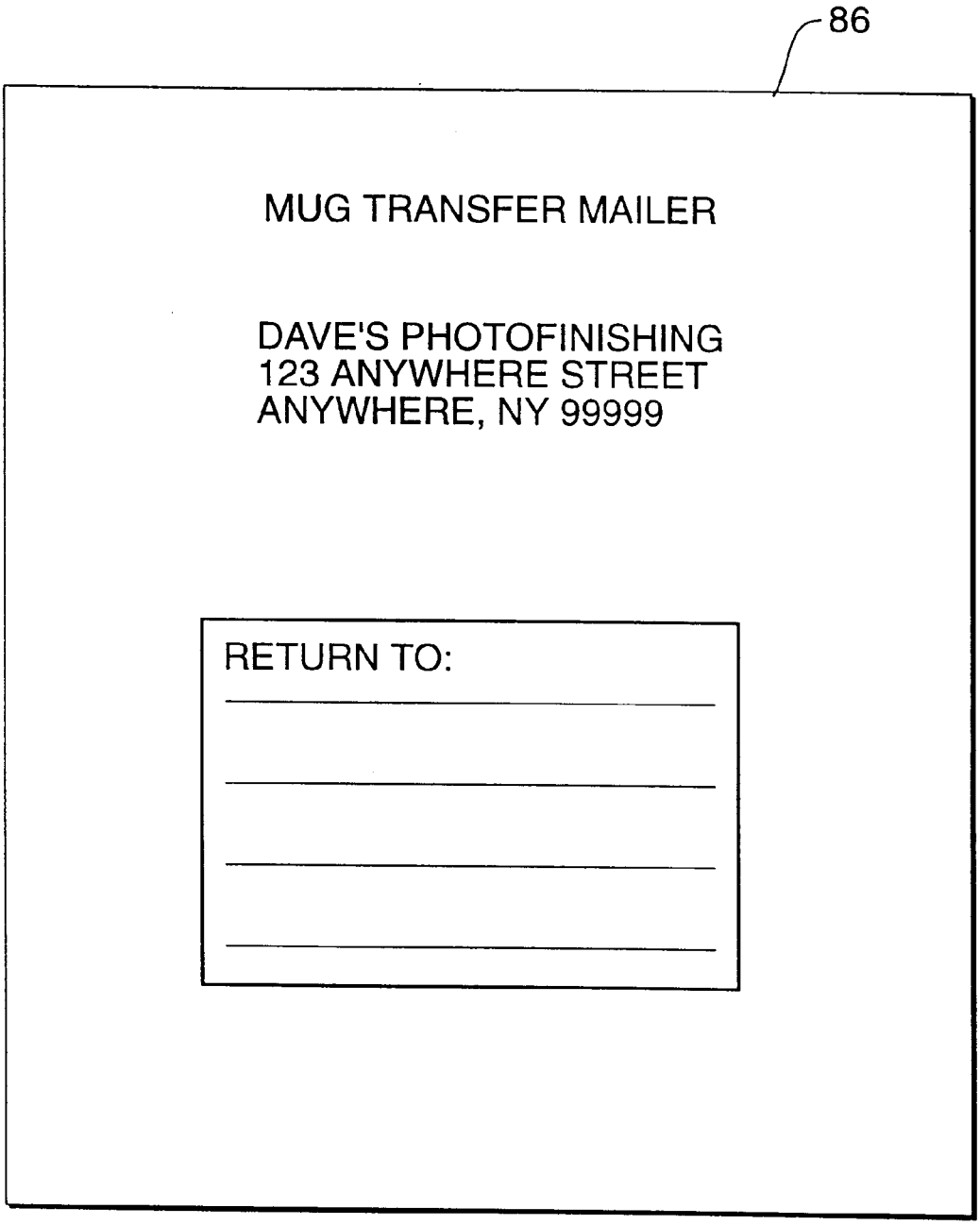
FIG. 21 is a schematic representation of a mailer provided in the kit according to the present invention.

It is to be understood that any other desired information and selection may be provided to the consumer as appropriate. The next step 78 is to determine whether the consumer wishes to proceed through this process again. If so, the consumer goes back to step 24 and repeats the foregoing described process. After the consumer has finished making the appropriate selections and recorded this information as required on the order form 50 at step 79, order form 50, along with the appropriate image or images 35 for ordering the transfer, is placed in the mailer 861 provided in the kit illustrated in FIG. 21. An appropriate ID card, not shown, may be provided which can be used for returning of the sublimation dye transfer to the consumer.

After an appropriate time period, a sublimation dye transfer, made in accordance with the request order form 50, is returned to the consumer at which time the sublimation dye transfer is used by the consumer for placing of the image on the mug 10. Appropriate directions for using the transfer is either originally supplied with the kit or provided with or printed on the transfer. In the embodiment illustrated, mug clamp 80, as illustrated in FIGS. 22 and 23, is provided with the original kit. A suitable clamp may be purchased from Fargo Electronics, Eden Paririe, Minn. Clamp 80 is designed to be used with mug 10. In particular, the clamp 80 is designed to securely hold in place a sublimation dye transfer 82, such that the sublimation dyes from the transfer 82 will be transferred onto the mug 10. The sublimation dye transfer 82 may be any type transfer as is commonly known and utilized for such purpose. The clamp 80 is preferably made of a material such that the clamp 80 is subjected will not be adversely affected by the heat it is to be subjected. In the embodiment illustrated, the clamp is made of metal, for example, steel or aluminum. The clamp 80 is designed with an over-the-center mechanism 84 so that the clamp can be secured and/or released from engagement with the cup and transfer 82. The clamp 80 comprises a flexible shell C-shaped member 81 having a smooth inner surface 83 made of an insulating material, such as silicone rubber, designed to engage the outer surface 85 of mug 10. In the embodiment illustrated, the over-the-center mechanism is disposed at one end of the member and comprises a lever 87 rotatably mounted to mount member 89 at one end 91. A clasp member 93 is provided having one end 95 pivotably mounted to lever 87 at a point 96 spaced from end 91 and a hook member 97 at the other end. The hook member 97 is designed to engage any one of the openings 99 provided in the other end of member 81. When the over-the-center mechanism 84 is in the open position as illustrated in FIG. 22, a sublimation dye transfer 82, having an image to be transferred thereon, can be easily inserted in position between the clamp 80 and mug 10, and once properly positioned, the clamp 80 is secured by moving the over-the-center mechanism 84 to the position illustrated in FIG. 23. When the over-the-center mechanism 84 of the clamp 80 is in the position as illustrated in FIG. 23B, a clamping force is applied against the mug 10 thereby clamping any sublimation dye transfer placed between the clamp 80 and mug 10. The mug 10, with the transfer 82 clamped thereto with the transfer therebetween is heated to the appropriate temperature for transferring of the image to the mug 10. Typically, this may be accomplished by placing the mug in a conventional heating oven, or in a microwave oven, if the clamp is made of an appropriate material.

It is to be understood that any appropriate clamping mechanism can be used so long as a sufficient degree of pressure is applied against the transfer to maintain the transfer in intimate and direct contact with the mug so that the heat being passed internally from the inside of the mug to the outside of the mug will pass directly to the clamp 80. Also, any desired heating mechanism may be employed so as to effectuate transfer of the image.

After the mug 10 is taken from the oven, it is allowed to cool to the appropriate temperature. The clamp 80 is then removed wherein the image will have been transferred onto the mug 10. With the foregoing system, additional mugs and sublimation dye transfers can be easily ordered for customizing various mugs by the consumer. Yet, a relatively small amount of investment is required by the consumer. In particular, a relatively small amount of money is required for purchasing the mug and clamp. In the particular embodiment illustrated, the clamp 80 is a relatively simple type structure having a generally metal structure having an over-the-center latch that allows the body member to be pressed against the mug when the over-the-center latch is in a closed position as illustrated. When the latch is in the open position, the clamp can be easily slid from around the mug or placed thereon, allowing sufficient room for placement of the sublimation dye transfer therebetween, or removal later after the image has been transferred. In the embodiment previously discussed, the mug was provided as part of the kit, however, in place of the mug, a mug selection sheet, or catalog may be provided (not shown) wherein the customer can order any desired shape and style mug appropriate for the clamp provided in the kit. Optionally, the kit may be provided without the clamp, and the clamp can be ordered after the selection of the mug type and size in which case the customer will then receive the appropriate size mug and clamp and dye transfer to be used therewith. The transferring of the image is accomplished in like manner as previously discussed.

While the foregoing allows the customer to obtain customized images on mugs of relatively modest cost, the customer may not be able to visually appreciate the final visual effect of the image in its final form. Therefore, for people who have home computers (personal computers), a kit can be provided wherein the consumer can easily determine the final shape and orientation of the image as it will actually appear on the mug. In particular, a kit may be provided with a software package (not shown) for use in the computer system illustrated in FIG. 24. The computer system 100 comprises a personal computer 110 having a monitor 112 for viewing information provided by the personal computer 110. The computer, in the embodiment illustrated, is connected to a scanner 114, which can be used to scan a print 116, or negative 118, whereby digital information regarding the image so scanned is forwarded to the personal computer 110. The computer also is provided with ports 120, 122 for receiving a CD 124, or computer disk 126, respectively, whereby digital information regarding the images can also be introduced to the personal computer 110. Additionally, the personal computer 110 may be hooked up to a modem 130, which is connected to outside sources for obtaining information and images as is normally done with such devices.

The system 100 further includes a printer 132 for producing images on a sublimation dye transfer 134. Directions as to proper use of the transfer for transferring the image to the mug may be provided on the transfer or on a separate instruction sheet also provided by printer 132. The software package may be provided with instructions for asking of the same questions discussed in the flowchart of FIG. 3. The major difference here is that the selected item can be automatically placed in the image area 16 illustrated on the monitor 112. Thus, the consumer can actually see the final image that is being formed on the image dye transfer, which is then transferred onto the mug 10.

The computer may also be provided with appropriate imaging manipulation software, such as the Adobe software package for manipulating images as desired.

Referring to FIG. 25, there is shown a flow chart illustrating how a kit of the present invention may be employed with a personal computer 110. The kit is purchased or otherwise provided to the consumer as indicated by step 136. The kit provides a software package (not shown) for use in the personal computer 110 shown in FIG. 24. The first step 138 would be to review the kit contents to assure that all items are provided to the consumer. The next step 140 is for the consumer to install the computer program embodying instructions and other appropriate information into the personal computer 110. Thereafter, the consumer follows the prompts to make the menu selections, step 142, shown on the computer monitor 112. Thereafter, the appropriate images, step 144, are also supplied via the computer. Appropriate questions are asked by the computer program, asking first for the consumer to choose the template, step 146, matching the mug type and style desired. At any time during the process, the choices made by the consumer can be previewed at step 148 via the display shown on the computer monitor 112. Next, the consumer chooses the image or images, step 150, he or she wants to appear on the mug. The consumer then decides, step 152, if they would like a border or no border as part of the mug image. Thereafter, the images are automatically placed into the image area template having the appropriate size that can be appropriately fitted into the available image area for that particular mug selection, step 154. The program, step 156, shows how the chosen image(s) will appear on the mug by correctly sizing the image(s) to fit the image are represented by the template. Additionally, appropriate inquires are made by the computer program that may be desired to be added as to border, steps 158, 160; text, font type, size, placement, and message, steps 162, 164, 166, 168, 170; and graphics, style, and position, steps 172, 174, 176. Referring back to step 148, the choices made may be previewed via the display shown on the computer monitor 112 at any time. Thereafter, after the image has been selected, an appropriate sublimation dye transfer sheet is placed in the import of the printer, whereby the image is then sent to the printer by the computer whereby the image is placed thereon, step 178. After the sublimation dye transfer has been made having the appropriate size for the selected mug, the image is transferred from the sublimation dye transfer onto the mug using clamp 80 as previously discussed. The next step 180 asks if the consumer would like to make another mug image transfer. If the consumer would like to make any transfer, step 182 returns the consumer back to obtaining a new image at step 144. If the consumer would like to make any transfer, step 184 ends the process.

It is to be understood that various other changes and modifications may be made without departing from the scope of the present invention. The present invention being defined by the following claims.

PARTS LIST

10 mug
14 peripheral wall
16 actual image area
18 handle
19 step
20 instruction sheet
22, 24, 25, 26 steps
28 template
29 maximum image area
30 outer peripheral line
32 inner peripheral line
33 peelable decal
34 border area
35, 35' images
36 step
37 print
39 print
41 step
42*a*, 42*b*, 42*c* location templates
42*d*, 42*e*, 42*f* location templates
46 vertical axis
47 step
48 horizontal axis
49, 49' cut-out template
50 order form
56, 57, 58, 59 steps
60, 61, 62, 63 border patterns
60*a*, 61*a*, 62*a*, 63*a* codes
66*a*, 66*b*, 66*c*, 66*d* message boxes
66*e*, 66*f*, 66*g*, 66*h* message boxes
67, 68, 69, 70, 71, 72 steps
74, 75, 76, 77, 78, 79 steps
90*a*, 90*b*, 90*c*, 90*d* graphics
92*a*, 92*b*, 92*c*, 92*d* codes
80 mug clamp
81 C-shaped member
82 sublimation dye transfer
83 inner surface
84 over-the-center mechanism
85 outer surface
86 mailer
87 lever
89 mount member
91 end
93 clasp member
95 end
96 point
97 hook member
99 openings
100 computer system
110 personal computer
112 monitor
114 scanner
116 print
118 negative
120, 122 ports
124 CD
126 computer disk
130 modem
132 printer
134 sublimation dye transfer
136, 138, 140, 142 steps
144, 146, 148 steps
150, 152, 154, 156 steps
158, 160, 162, 164 steps
166, 168, 170, 172 steps
174, 176, 178, 180 steps
182, 184 steps

What is claimed is:

1. A kit for producing images on a mug, the kit comprising:

a) a mug;

b) at least one—unimaged—dye transfer for receiving an image thereon from a printer; and c) a computer software program for controlling a computer for manipulation of an image that is to be placed on said transfer so that it will properly fit on said transfer.

2. A kit according to claim 1 wherein said software program also provides instructions directly on said transfer that can be followed in the transferring of the image onto the mug.

3. A kit according to claim 1 wherein said software program produces a template for proper sizing of the transfer.

4. A kit according to claim 1 wherein said program allows previewing of image as it would appear on the mug at anytime.

5. A system for producing images on a mug, the system comprising:

a) a computer;

b) a printer connected to said computer;

c) a mug;

d) at least one—unimaged—dye transfer for receiving an image thereon from said printer; and e) a computer software program for controlling said computer for manipulation of an image that is to be placed on said transfer so that it will properly fit on said transfer.

6. A system according to claim 5 wherein said software program also provides instructions directly on said transfer that can be followed in the transferring of the image onto the mug.

7. A system according to claim 5 wherein said software program produces a template for proper sizing of the transfer.

8. A system according to claim 5 wherein said program allows previewing of image as it would appear on the mug at anytime.

* * * * *